US011512709B2

(12) United States Patent
Iwata et al.

(10) Patent No.: US 11,512,709 B2
(45) Date of Patent: Nov. 29, 2022

(54) PROPELLER FAN

(71) Applicant: DAIKIN INDUSTRIES, LTD., Osaka (JP)

(72) Inventors: Tooru Iwata, Osaka (JP); Hirotaka Tomioka, Osaka (JP); Kaname Maruyama, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/620,182

(22) PCT Filed: May 28, 2018

(86) PCT No.: PCT/JP2018/020377
§ 371 (c)(1),
(2) Date: Dec. 6, 2019

(87) PCT Pub. No.: WO2018/235531
PCT Pub. Date: Dec. 27, 2018

(65) Prior Publication Data

US 2020/0088211 A1 Mar. 19, 2020

(30) Foreign Application Priority Data

Jun. 19, 2017 (JP) ..... JP2017-119658

(51) Int. Cl.
*F04D 29/38* (2006.01)
*F04D 29/66* (2006.01)

(52) U.S. Cl.
CPC ..... *F04D 29/384* (2013.01); *F04D 29/666* (2013.01); *F05B 2240/301* (2013.01); *F05B 2260/96* (2013.01)

(58) Field of Classification Search
None
See application file for complete search history.

(56) References Cited

U.S. PATENT DOCUMENTS

| | | | | |
|---|---|---|---|---|
| 8,656,589 | B2 * | 2/2014 | Kurt-Elli | F04D 29/666 29/889.2 |
| 10,480,527 | B2 * | 11/2019 | Van Houten | F04D 29/388 |
| 2018/0320705 | A1 * | 11/2018 | Van Houten | F04D 29/666 |

FOREIGN PATENT DOCUMENTS

| | | | |
|---|---|---|---|
| EP | 1813773 | A2 | 8/2007 |
| JP | 5-223093 | A | 8/1993 |
| JP | 10-176694 | A | 6/1998 |
| JP | 10176694 | A * | 6/1998 |
| JP | 11-201091 | A | 7/1999 |

(Continued)

*Primary Examiner* — Juan G Flores
(74) *Attorney, Agent, or Firm* — Birch, Stewart, Kolasch & Birch, LLP

(57) ABSTRACT

Blades (20*a* to 20*c*) of a propeller fan (10) have different circumferential pitches φ1, φ2, and φ3. The blades (20*a* to 20*c*) have different masses so that the center of gravity of the propeller fan (10) is positioned on a rotational center axis (11) of the propeller fan (10). Blade body portions (42*c*) of the blades (20*a* to 20*c*) have different thicknesses. In contrast, camber lines of the blades (20*a* to 20*c*) in blade cross section have the same shape, projections of the blades (20*a* to 20*c*) on a plane perpendicular to the rotational center axis (11) of the propeller fan (10) have the same shape, and leading edge portions (41*a* to 41*c*) of the blades (20*a* to 20*c*) have the same shape. As a result, a propeller fan (10) having reduced noise and vibrations can be achieved.

7 Claims, 4 Drawing Sheets

(56) References Cited

FOREIGN PATENT DOCUMENTS

| | | | | |
|---|---|---|---|---|
| JP | 11201091 | A | * | 7/1999 |
| JP | 2015-86803 | A | | 5/2015 |
| WO | 101285484 | A | | 10/2008 |

* cited by examiner

PROPELLER FAN

TECHNICAL FIELD

The present invention relates to a propeller fan for use in a blower or any other device.

BACKGROUND ART

A propeller fan has been widely used for a blower or any other device. Noise generated through rotation of the propeller fan includes periodic noise called NZ noise. The frequency of the NZ noise is the product of the number of blades of the propeller fan and the rotational speed of the propeller fan. Patent Document 1 shows that to reduce the discomfort of a user or any other person resulting from such NZ noise, blades are arranged at unequal pitches in the circumferential direction of a propeller fan.

Here, if the blades having the same mass are arranged at unequal pitches in the circumferential direction of the propeller fan, the propeller fan is rotationally unbalanced. Specifically, the center of gravity of the propeller fan and the rotational center axis of the propeller fan are apart from each other. In this state, if the rotationally unbalanced propeller fan is rotated, such rotational unbalance may cause the propeller fan to vibrate.

To address this problem, in Patent Document 1, four blades having different leading edge shapes (and thus having different masses) are arranged at unequal pitches in the circumferential direction of the propeller fan to reduce the degree to which the propeller fan is rotationally unbalanced.

CITATION LIST

Patent Document

[Patent Document 1] Japanese Unexamined Patent Publication No. H05-233093

SUMMARY OF THE INVENTION

Technical Problem

Here, blades having different shapes cause different aerodynamic forces to act on these blades. Thus, if a propeller fan includes blades having different leading edge shapes as disclosed in Patent Document 1, different aerodynamic forces act on these blades. This may increase noise. For this reason, even if the propeller fan of Patent Document 1 can reduce the discomfort resulting from NZ noise, the overall level of blowing sound increases. Eventually, the problem of the discomfort resulting from noise may be unable to be solved.

In view of the foregoing background, it is therefore an object of the present invention to provide a high-performance propeller fan that reduces problems resulting from noise and vibrations.

Solution to the Problem

A first aspect of the invention is directed to a propeller fan (10) including a hub (15) formed into a cylindrical shape; and a plurality of blades (20*a* to 20*c*) extending outward from a side of the hub (15). At least two of the blades (20*a* to 20*c*) have different circumferential pitches. At least two of the blades (20*a* to 20*c*) have different masses so that a center of gravity of the propeller fan (10) is positioned near or on a rotational center axis (11) of the propeller fan (10). Projections of the blades (20*a* to 20*c*) on a plane orthogonal to the rotational center axis (11) of the propeller fan (10) have a common shape. Leading edge portions (41*a* to 41*c*) of the blades (20*a* to 20*c*) have a common shape.

In the first aspect of the invention, at least two of the blades (20*a* to 20*c*) of the propeller fan (10) have different circumferential pitches. This reduces the discomfort resulting from so-called NZ noise. In this aspect of the invention, at least two of the blades (20*a* to 20*c*) of the propeller fan (10) have different masses so that the center of gravity of the propeller fan (10) is positioned near or on the rotational center axis (11) of the propeller fan (10). This allows the propeller fan (10) to be kept rotationally balanced, and can reduce vibrations resulting from the rotationally unbalanced propeller fan (10).

In the propeller fan (10) of the first aspect of the invention, two of the blades having different circumferential pitches do not always have different masses. Two of the blades having different masses do not always have different circumferential pitches.

In the propeller fan (10) of the first aspect of the invention, the projections of all of the blades (20*a* to 20*c*) on the plane orthogonal to the rotational center axis (11) of the propeller fan (10) (i.e., the blades (20*a* to 20*c*) viewed from the rotational center axis (11) of the propeller fan (10)) have a common shape. The leading edge portions (41*a* to 41*c*) of all of the blades (20*a* to 20*c*) have a common shape. The blades (20*a* to 20*c*) include at least two blades having different masses. The shapes of the blades (20*a* to 20*c*) viewed from the rotational center axis (11) of the propeller fan (10) and the shapes of the leading edge portions (41*a* to 41*c*) of the blades (20*a* to 20*c*) significantly affect the aerodynamic forces acting on the blades (20*a* to 20*c*). Thus, if these shapes are common among all of the blades (20*a* to 20*c*), the aerodynamic forces acting on the blades (20*a* to 20*c*) of the propeller fan (10) are equalized. The term "common" as used herein includes not only the case where they are completely identical, but also the case where there is a slight difference small enough not to affect the aerodynamic forces acting on the blades (20*a* to 20*c*).

A second aspect of the invention is an embodiment of the first aspect of the invention. In the second aspect, regions of the blades (20*a* to 20*c*) closer to trailing edges (24*a* to 24*c*) than to the leading edge portions (41*a* to 41*c*) may partly or entirely have different thicknesses, the blades (20*a* to 20*c*) having different masses.

Here, the shapes of the regions of the blades (20*a* to 20*c*) closer to the trailing edges (24*a* to 24*c*) than to the leading edge portions (41*a* to 41*c*) insignificantly affect the aerodynamic forces acting on the blades (20*a* to 20*c*). To address this problem, in the second aspect of the invention, different thicknesses of portions or entireties of the regions of the blades (20*a* to 20*c*) closer to the trailing edges (24*a* to 24*c*) than to the leading edge portions (41*a* to 41*c*) allow the blades (20*a* to 20*c*) to have different masses.

A third aspect of the invention is an embodiment of the first or second aspect of the invention. In the third aspect, all of the blades (20*a* to 20*c*) may have different circumferential pitches and different masses.

In the third aspect of the invention, the blades (20*a* to 20*c*) of the propeller fan (10) have different circumferential pitches and different masses. This reduces the differences among the circumferential pitches of the blades (20*a* to 20*c*) and the differences among the masses of the blades (20*a* to 20*c*).

A fourth aspect of the invention is an embodiment of the third aspect of the invention. In the fourth aspect, one of the blades (20*a* to 20*c*) having a greater circumferential pitch may have a smaller mass.

In the fourth aspect of the invention, one (20*c*) of the blades (20*a* to 20*c*) of the propeller fan (10) having a greater circumferential pitch has a smaller mass, and one (20*a*) of the blades having a smaller circumferential pitch has a greater mass.

A fifth aspect of the invention is an embodiment of any one of the first to fourth aspects of the invention. In the fifth aspect, the blades (20*a* to 20*c*) may each have a protrusion (45*a* to 45*c*) extending along an associated one of the leading edge portions (41*a* to 41*c*) and protruding toward a positive pressure surface (25*a* to 25*c*), and the protrusions (45*a* to 45*c*) of all of the blades (20*a* to 20*c*) may have a common shape.

In the fifth aspect of the invention, the blades (20*a* to 20*c*) of the propeller fan (10) each have a protrusion (45*a* to 45*c*). The protrusion (45*a* to 45*c*) protrudes toward the positive pressure surface (25*a* to 25*c*) of the blade (20*a* to 20*c*), and extends along the leading edge (23*a* to 23*c*) of the blade (20*a* to 20*c*). Each blade (20*a* to 20*c*) having the protrusion (45*a* to 45*c*) allows air to flow smoothly and separately toward the associated positive pressure surface (25*a* to 25*c*) and the associated negative pressure surface (26*a* to 26*c*) of the blade at the leading edge (23*a* to 23*c*) of the blade (20*a* to 20*c*). This can reduce noise. The protrusions (45*a* to 45*c*) are respectively disposed along the leading edges (23*a* to 23*c*) of the blades (20*a* to 20*c*). Thus, the shapes of the protrusions (45*a* to 45*c*) relatively significantly affect the aerodynamic forces acting on the blades (20*a* to 20*c*). Thus, in this aspect of the invention, the protrusions (45*a* to 45*c*) of all of the blades (20*a* to 20*c*) of the propeller fan (10) have a common shape.

Advantages of the Invention

A propeller fan (10) of the present invention includes blades (20*a* to 20*c*) having unequal circumferential pitches. This can reduce the discomfort resulting from the so-called NZ noise, and the blades (20*a* to 20*c*) having unequal masses can reduce vibrations of the propeller fan (10). Furthermore, in the propeller fan (10) of the present invention, one or more of various shapes of the blades (20*a* to 20*c*) significantly affecting the aerodynamic forces acting on the blades (20*a* to 20*c*) are common among all the blades (20*a* to 20*c*). This enables equalization of the aerodynamic forces acting on the blades (20*a* to 20*c*) of the propeller fan (10), and can reduce the degree to which noise increases due to different aerodynamic forces acting on the blades (20*a* to 20*c*). Thus, the present invention can provide a high-performance propeller fan (10) capable of reducing the discomfort resulting from NZ noise while reducing the degrees to which noise and vibrations increase.

In the second aspect of the invention, different thicknesses of regions of the blades (20*a* to 20*c*) closer to the trailing edges (24*a* to 24*c*) than to the leading edge portions (41*a* to 41*c*) allow the blades (20*a* to 20*c*) to have different masses. Thus, this embodiment allows at least two of the blades (20*a* to 20*c*) of the propeller fan (10) to have different masses while enabling equalization of the aerodynamic forces acting on the blades (20*a* to 20*c*).

In the third and fourth aspects of the invention, since the blades (20*a* to 20*c*) of the propeller fan (10) have different circumferential pitches and different masses, the differences among the circumferential pitches of the blades (20*a* to 20*c*) and the differences among the masses of the blades (20*a* to 20*c*) can be minimized. Thus, these aspects of the invention can reliably shorten the distance between the center of gravity of the propeller fan (10) and the rotational center axis (11) of the propeller fan (10), and allows the propeller fan (10) to be rotationally balanced with ease and reliability.

According to the fifth aspect of the invention, protrusions (45*a* to 45*c*) of all of the blades (20*a* to 20*c*) of the propeller fan (10) relatively significantly affecting the aerodynamic forces acting on the blades (20*a* to 20*c*) have a common shape. Thus, according to this aspect of the invention, the provision of the protrusions (45*a* to 45*c*) effectively reduces noise, and the aerodynamic forces acting on the blades (20*a* to 20*c*) of the propeller fan (10) can be equalized, thereby further reducing noise.

DESCRIPTION OF EMBODIMENTS

Embodiments of the present invention will be described in detail with reference to the drawings. Note that the following embodiments and variations are merely beneficial examples in nature, and are not intended to limit the scope, applications, or use of the invention.

First Embodiment

A first embodiment will be described. A propeller fan (10) of this embodiment is configured as an axial fan. The propeller fan (10) is provided, for example, in a heat source unit of an air conditioner, and is used to supply outdoor air to a heat-source-side heat exchanger.

—Propeller Fan Configuration—

Figure 1:
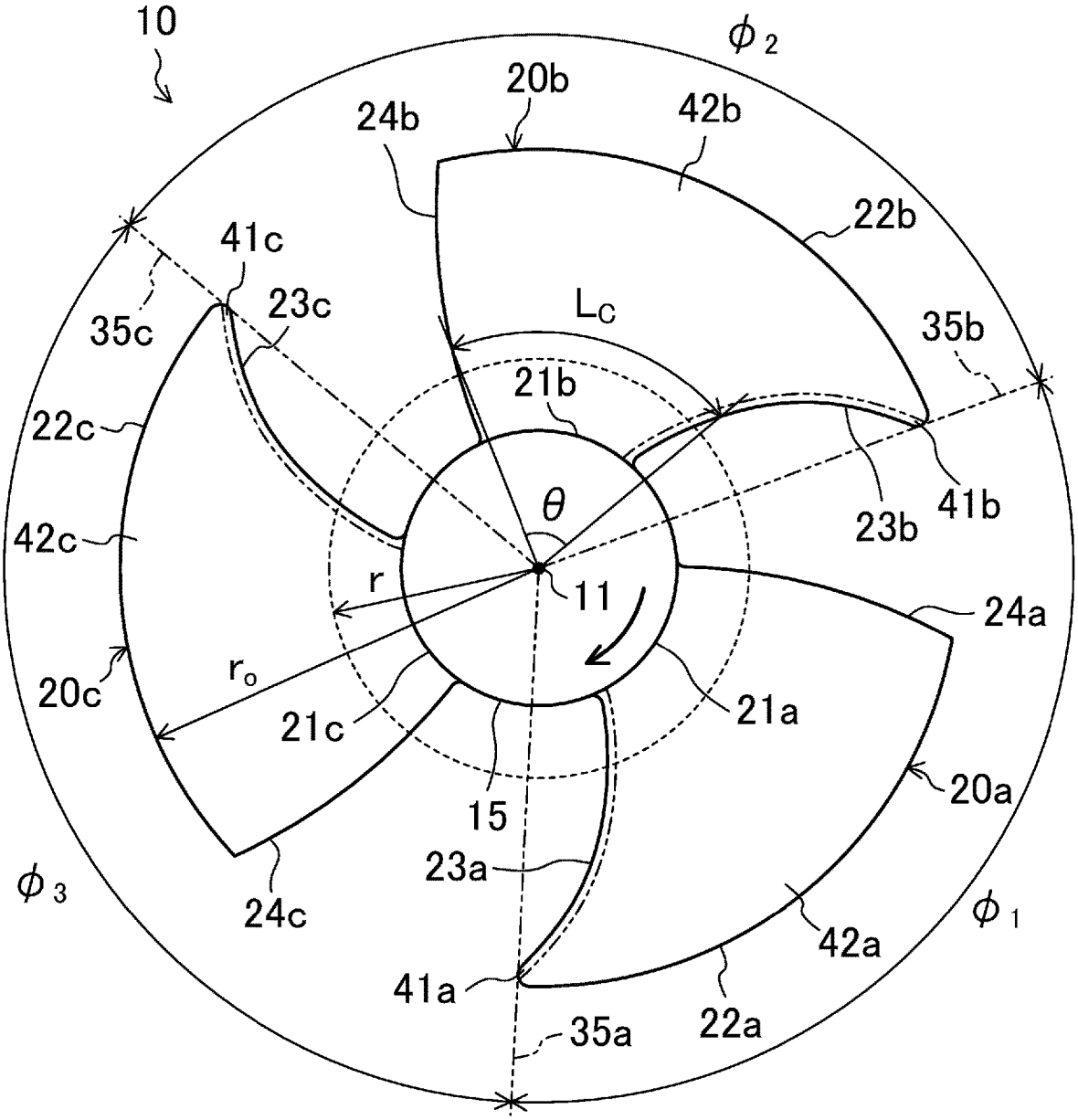
FIG. 1 is a plan view of a propeller fan of a first embodiment.

As shown in FIG. 1, the propeller fan (10) of this embodiment includes one hub (15) and three blades (20*a*, 20*b*, 20*c*). The hub (15) and the three blades (20*a* to 20*c*) are integrally formed. The propeller fan (10) is made of a resin.

The hub (15) is formed into a shape of a cylinder whose tip end face is closed. The hub (15) is attached to a drive shaft of a fan motor. The center axis of the hub (15) is a rotational center axis (11) of the propeller fan (10).

Each blade (20*a* to 20*c*) is arranged to project outwardly from the outer peripheral surface of the hub (15). The three blades (20*a* to 20*c*) are arranged at predetermined intervals in the circumferential direction of the hub (15). Each blade (20*a* to 20*c*) has a shape extending toward the outside in the radial direction of the propeller fan (10). The shapes and circumferential pitches of the blades (20*a* to 20*c*) will be described below.

Each blade (20*a* to 20*c*) has an end portion located near a radially central portion of the propeller fan (10) (i.e., near the hub (15)) and serving as a blade root (21*a*, 21*b*, 21*c*), and an end portion located near the radially outer end of the propeller fan (10) and serving as a blade end (22*a*, 22*b*, 22*c*). The blade roots (21*a* to 21*c*) of the blades (20*a* to 20*c*) are joined to the hub (15).

Each blade (20*a* to 20*c*) has a front edge in the rotation direction of the propeller fan (10) as a leading edge (23*a*, 23*b*, 23*c*), and a rear edge in the rotation direction of the propeller fan (10) as a trailing edge (24*a*, 24*b*, 24*c*). The leading edge (23*a* to 23*c*) and the trailing edge (24*a* to 24*c*) of the blade (20*a* to 20*c*) extend from the blade root (21*a* to 21*c*) toward the blade end (22*a* to 22*c*) and thus extend toward the outer circumferential side of the propeller fan (10).

Each blade (20*a* to 20*c*) is inclined with respect to a plane orthogonal to the rotational center axis (11) of the propeller fan (10). Specifically, the blade (20*a* to 20*c*) is arranged such that the leading edge (23*a* to 23*c*) is located near a tip end of the hub (15), and the trailing edge (24*a* to 24*c*) is located near a base end of the hub (15). The blade (20*a* to 20*c*) is configured such that a front surface (a downward face in FIGS. 2A to 2C) in the rotation direction of the propeller fan (10) is a positive pressure surface (25*a*, 25*b*, 25*c*), and a rear surface (an upward face in FIGS. 2A to 2C) in the rotation direction of the propeller fan (10) is a negative pressure surface (26*a*, 26*b*, 26*c*).

—Shapes of Blades—

The shapes of the blades (20) will be described with reference to FIGS. 1 and 2A to 2C.

Figure 2A:
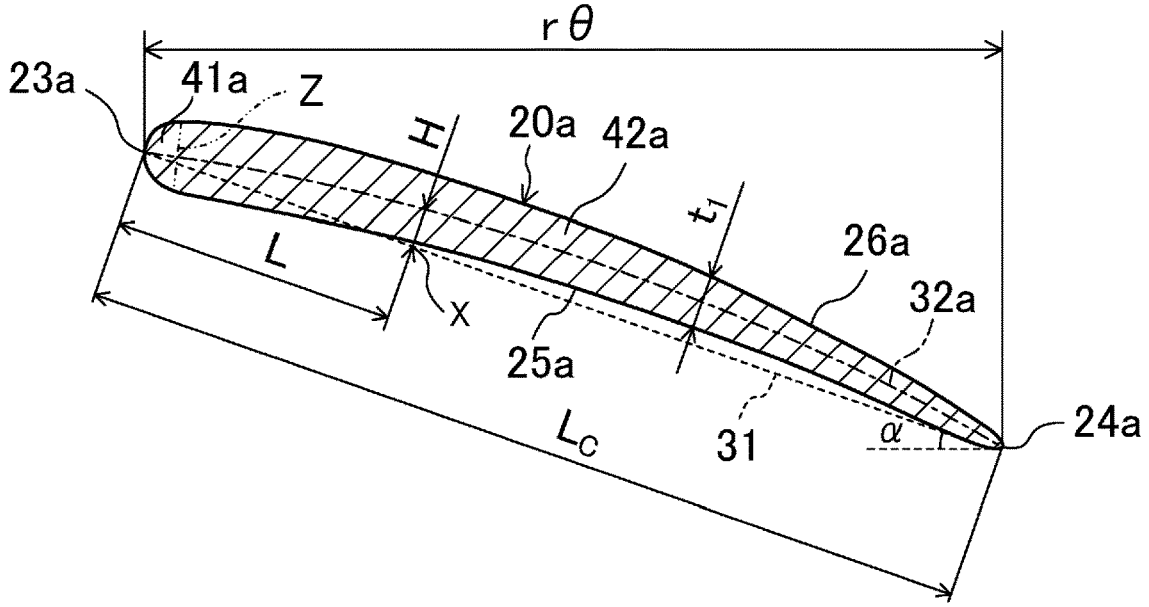
FIG. 2A is a cross-sectional view of a first blade of the first embodiment.
Figure 2B:
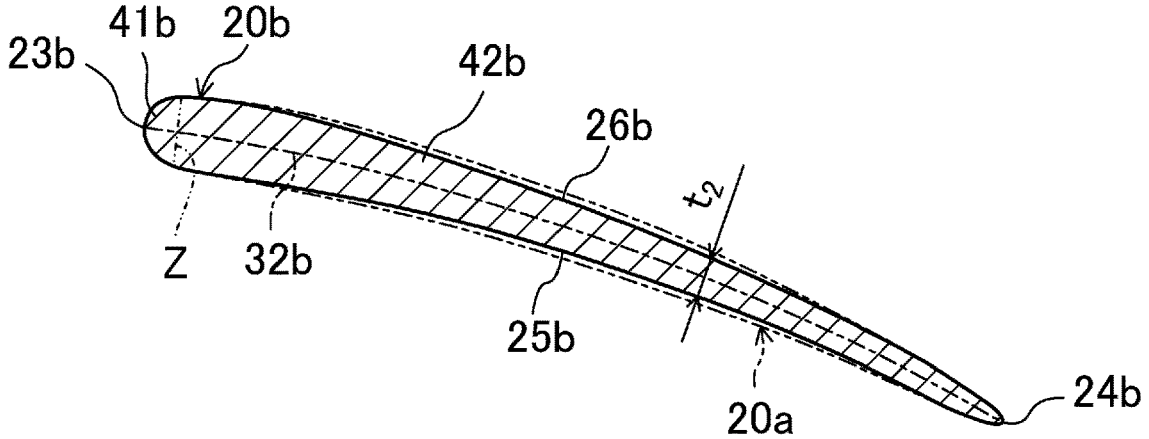
FIG. 2B is a cross-sectional view of a second blade of the first embodiment.
Figure 2C:
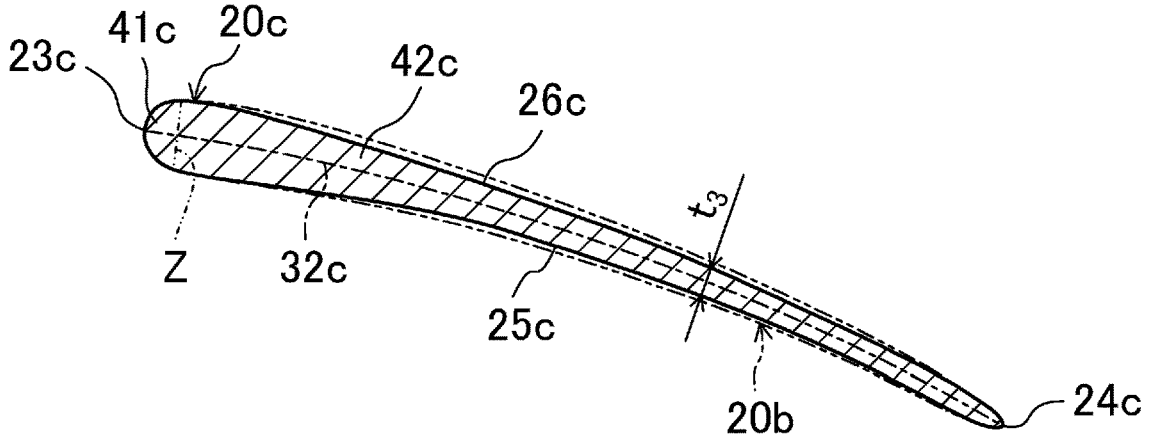
FIG. 2C is a cross-sectional view of a third blade of the first embodiment.

The blade cross sections shown in FIGS. 2A to 2C are respectively views in which curved cross sections, of the blades (20*a* to 20*c*), located at a distance r from the rotational center axis (11) of the propeller fan (10) are shown in a flattened state. The blades (20*a* to 20*c*) are respectively cambered so as to bulge toward the negative pressure surfaces (26*a* to 26*c*).

In the blade cross section of each blade (20*a* to 20*c*), a line segment connecting the leading edge (23*a* to 23*c*) and the trailing edge (24*a* to 24*c*) is a chord line (31), and an angle formed by the chord line (31) with the "plane orthogonal to the rotational center axis (11) of the propeller fan (10)" is an attaching angle $\alpha$. The chord length $L_C$ is a value obtained through dividing the length $r\theta$ of an arc having a radius r and a central angle $\theta$ by a cosine $\cos\alpha$ with respect to the attaching angle $\alpha$ ($L_C = r\theta/\cos\alpha$). Note that $\theta$ is a central angle of the blade (20) at the position located at the distance r from the rotational center axis (11) of the propeller fan (10) (see FIG. 1), and the unit thereof is radian.

In each of the blade cross sections shown in FIGS. 2A to 2C, a line connecting the midpoints of the positive pressure surface (25*a* to 25*c*) and the negative pressure surface (26*a* to 26*c*) is a camber line (32*a*, 32*b*, 32*c*), and the distance from the chord line (31) to the camber line (32*a* to 32*c*) is a camber H. The shape of the camber line (32*a* to 32*c*) in each blade cross section is determined by the distance L from the leading edge (23*a* to 23*c*) to an optional point X on the chord line (31), the distance from the point X to the camber line (32*a* to 32*c*) (i.e., the camber H at the point X), and the chord length $L_C$.

The camber lines (32*a* to 32*c*) of the blades (20*a* to 20*c*) have the same shape. Specifically, the blades (20*a* to 20*c*) have the same camber H at the optional point X on the chord line (31) and the same chord length $L_c$ in the blade cross section located at the optional distance r from the rotational center axis (11) of the propeller fan (10).

Note that two objects cannot actually have completely the same shape and size. Thus, "the same" as used herein includes not only the case where they are completely the same, but also the case where they are different by about a usual tolerance. In other words, "the same" as used herein further includes the case where it can be said that they are not completely the same but substantially the same.

Projections of the blades (20*a* to 20*c*) on the plane orthogonal to the rotational center axis (11) of the propeller fan (10) have the same shape. In other words, the shapes of the blades (20*a* to 20*c*) shown in FIG. 1 (i.e., the shapes of the blades viewed from the rotational center axis (11) of the propeller fan (10)) are the same. Thus, the leading edges (23*a* to 23*c*) of the blades (20*a* to 20*c*) have the same shape, and the trailing edges (24*a* to 24*c*) of the blades (20*a* to 20*c*) have the same shape.

A portion of each blade (20*a* to 20*c*) extending along the associated leading edge (23*a* to 23*c*) forms a leading edge portion (41*a*, 41*b*, 41*c*), and the remaining portion thereof forms a blade body portion (42*a*, 42*b*, 42*c*).

The leading edge portions (41*a* to 41*c*) are respectively regions of the blades (20*a* to 20*c*) near the leading edges (23*a* to 23*c*), and respectively extend across the lengths of the leading edges (23*a* to 23*c*). A region of each blade (20*a* to 20*c*) of this embodiment that is closer to the associated leading edge (23*a* to 23*c*) than a portion of the blade (20*a* to 20*c*) having the largest thickness $t_1$, $t_2$, $t_3$ (an associated one of phantom planes Z shown in FIGS. 2A to 2C) forms the leading edge portion (41*a* to 41*c*). The thickness $t_1$, $t_2$, $t_3$ of each blade (20*a* to 20*c*) is the interval between the positive pressure surface (25*a* to 25*c*) and the negative pressure surface (26*a* to 26*c*) on a straight line perpendicular to the camber line (32*a* to 32*c*).

The blade body portions (42*a* to 42*c*) respectively extend from the leading edge portions (41*a* to 41*c*) to the trailing edges (24*a* to 24*c*). A region of each blade (20*a* to 20*c*) other than the leading edge portion (41*a* to 41*c*) forms the blade body portion (42*a* to 42*c*).

The leading edge portions (41*a* to 41*c*) of the blades (20*a* to 20*c*) have the same shape. In other words, the leading edges (23*a* to 23*c*) of the leading edge portions (41*a* to 41*c*) of the blades (20*a* to 20*c*) have the same shape, portions of the camber lines (32*a* to 32*c*) in the leading edge portions (41*a* to 41*c*) have the same shape, and the thicknesses $t_1$, $t_2$, and $t_3$ of the leading edge portions (41*a* to 41*c*) are the same.

The blade body portions (42*a* to 42*c*) of the blades (20*a* to 20*c*) have different thicknesses $t_1$, $t_2$, and $t_3$.

As shown in FIG. 2B, the average thickness $t_2$ of the blade body portion ($\mathbf{42}_b$) of a second blade (20*b*) is smaller than the average thickness $t_1$ of the blade body portion (42*a*) of a first blade (20*a*). The difference ($t_1 - t_2$) between the thickness $t_2$ of the blade body portion (42*b*) of the second blade (20*b*) and the thickness $t_1$ of the blade body portion (42*a*) of the first blade (20*a*) gradually increases from the leading edge portion ($\mathbf{41}_b$) toward the trailing edge (24*a* to 24*c*), becomes maximum at the intermediate position between the leading edge portion ($\mathbf{41}_b$) and the trailing edge (24*a* to 24*c*), and gradually decreases from the position at which the difference ($t_1 - t_2$) is maximum toward the trailing edge (24*a* to 24*c*).

As shown in FIG. 2C, the average thickness $t_3$ of the blade body portion (42*c*) of a third blade (20*c*) is smaller than the average thickness $t_2$ of the blade body portion ($\mathbf{42}_b$) of the second blade (20*b*). The difference ($t_2 - t_3$) between the thickness $t_3$ of the blade body portion (42*c*) of the third blade (20*c*) and the thickness $t_2$ of the blade body portion (42*b*) of the second blade (20*b*) gradually increases from the leading edge portion (41*c*) toward the trailing edge (24*a* to 24*c*), becomes maximum at the intermediate position between the leading edge portion (41*c*) and the trailing edge (24*a* to 24*c*), and gradually decreases from the position at which the difference ($t_2-t_3$) is maximum toward the trailing edge (24*a* to 24*c*).

—Arrangement of Blades—

In the propeller fan (10) of this embodiment, the blades (20*a* to 20*c*) have different circumferential pitches $\varphi_1$, $\varphi_2$, and $\varphi_3$.

Here, in each blade (20*a* to 20*c*), a plane including the rotational center axis (11) of the propeller fan (10) and being in contact with the leading edge (23*a* to 23*c*) of the blade (20*a* to 20*c*) is defined as a front end plane (35*a*, 35*b*, 35*c*). The front end plane (35*a*) of the first blade (20*a*) includes the rotational center axis (11) of the propeller fan (10), and is in contact with the leading edge (23*a*) of the first blade (20*a*). The front end plane (35*b*) of the second blade (20*b*) includes the rotational center axis (11) of the propeller fan (10), and is in contact with the leading edge (23*b*) of the second blade (20*b*). The front end plane (35*c*) of the third blade (20*c*) includes the rotational center axis (11) of the propeller fan (10), and is in contact with the leading edge (23*c*) of the third blade (20*c*).

The circumferential pitch $\varphi_1$, $\varphi_2$, $\varphi_3$ of each blade (20*a* to 20*c*) is an angle formed between the front end plane (35*a*, 35*b*, 35*c*) of the blade (20*a*, 20*b*, 20*c*) and the front end plane (35*b*, 35*c*, 35*a*) of another one of the blades (20*b*, 20*c*, 20*a*) located behind the blade (20*a* to 20*c*) in the rotation direction of the propeller fan (10). Specifically, the circumferential pitch $\varphi_1$ of the first blade (20*a*) is an angle formed between the front end plane (35*a*) of the first blade (20*a*) and the front end plane ($35_b$) of the second blade (20*b*). The circumferential pitch $\varphi_2$ of the second blade (20*b*) is an angle formed between the front end plane (35*b*) of the second blade (20*b*) and the front end plane (35*c*) of the third blade (20*c*). The circumferential pitch $\varphi_3$ of the third blade (20*c*) is an angle formed between the front end plane (35*c*) of the third blade (20*c*) and the front end plane (35*a*) of the first blade (20*a*).

In the propeller fan (10) of this embodiment, the circumferential pitches $\varphi_1$, $\varphi_2$, and $\varphi_3$ of the first, second, and third blades (20*a*), (20*b*), and (20*c*) become increasingly greater in this order. In other words, the circumferential pitch $\varphi_3$ of the third blade (20*c*) is greater than the circumferential pitch $\varphi_2$ of the second blade (20*b*), and the circumferential pitch $\varphi_2$ of the second blade (20*b*) is greater than the circumferential pitch (in of the first blade (20*a*) ($\varphi_1<\varphi_2<\varphi_3$). In the propeller fan (10) of this embodiment, the circumferential pitch $\varphi_1$ of the first blade (20*a*) is 114°, the circumferential pitch $\varphi_2$ of the second blade (20*b*) is 119°, and the circumferential pitch $\varphi_3$ of the third blade (20*c*) is 127°. Note that values of the circumferential pitches $\varphi_1$, $\varphi_2$, and $\varphi_3$ shown here are merely examples.

Masses of Blades and Center of Gravity of Propeller Fan—

As described above, the average thicknesses $t_1$, $t_2$, and $t_3$ of the blade body portions (42*a* to 42*c*) of the first, second, and third blades (20*a*), (20*b*), and (20*c*) become increasingly smaller in this order. Thus, the masses of the first, second, and third blades (20*a*), (20*b*), and (20*c*) become increasingly smaller in this order. In other words, the mass $M_3$ of the third blade (20*c*) is smaller than the mass $M_2$ of the second blade (20*b*), and the mass $M_2$ of the second blade (20*b*) is smaller than the mass $M_1$ of the first blade (20*a*) ($M_3<M_2<M_1$). In the propeller fan (10) of this embodiment, the mass $M_2$ of the second blade (20*b*) is about 95% of the mass $M_1$ of the first blade (20*a*), and the mass $M_3$ of the third blade (20*c*) is about 85% of the mass $M_1$ of the first blade (20*a*). Note that the ratios among the masses $M_1$, $M_2$, and $M_3$ shown here are merely examples.

The masses $M_1$, $M_2$, and $M_3$ of the blades (20*a* to 20*c*) are determined so that the center of gravity of the propeller fan (10) is positioned on the rotational center axis (11) of the propeller fan (10). The center of gravity of the propeller fan (10) of this embodiment is positioned substantially on the rotational center axis (11) of the propeller fan (10). If the distance from the rotational center axis (11) of the propeller fan (10) to the center of gravity of the propeller fan (10) is approximately equal to a general tolerance, the center of gravity of the propeller fan (10) can be said to be positioned substantially on the rotational center axis (11) of the propeller fan (10).

The center of gravity of the propeller fan (10) may be slightly apart from the rotational center axis (11) of the propeller fan (10). If the distance between the center of gravity of the propeller fan (10) and the rotational center axis (11) of the propeller fan (10) is generally less than or equal to 0.5% of the outer diameter of the propeller fan (10), the propeller fan (10) is substantially rotationally balanced.

The outer diameter of the propeller fan (10) is the diameter of a cylindrical surface having a center axis that coincides with the rotational center axis (11) of the propeller fan (10) and circumscribing the propeller fan (10). The outer diameter D of the propeller fan (10) of this embodiment is twice as large as the distance $r_o$ from the rotational center axis (11) of the propeller fan (10) to the blade ends (22*a* to 22*c*) ($D=2r_o$).

—Aerodynamic Forces Acting on Blades—

The propeller fan (10) of this embodiment is driven by a fan motor connected to the hub (15), and rotates in the clockwise direction of FIG. 1. When the propeller fan (10) rotates, air is pushed out in the direction of the rotational center axis (11) of the propeller fan (10) by the blades (20*a* to 20*c*).

Aerodynamic forces act on the blades (20*a* to 20*c*) of the propeller fan (10). Specifically, in each blade (20*a* to 20*c*), the air pressure on the positive pressure surface (25*a* to 25*c*) side becomes higher than the atmospheric pressure, and the air pressure on the negative pressure surface (26*a* to 26*c*) side becomes lower than the atmospheric pressure. Therefore, lift force is applied to each of the blades (20*a* to 20*c*) of the propeller fan (10). The lift force pushes the blades (20*a* to 20*c*) in the direction from the positive pressure surface (25*a* to 25*c*) toward the negative pressure surface (26*a* to 26*c*). The lift force is a reaction force for the force with which each of the blades (20*a* to 20*c*) of the propeller fan (10) pushes out air.

As described above, the blade body portions (42*a* to 42*c*) of the blades (20*a* to 20*c*) of the propeller fan (10) of this embodiment have different thicknesses $t_1$, $t_2$, and $t_3$. However, the camber lines (32*a* to 32*c*) have the same shape, projections of the blades (20*a* to 20*c*) on the plane perpendicular to the rotational center axis (11) of the propeller fan (10) have the same shape, and the leading edge portions (41*a* to 41*c*) have the same shape. In other words, the shapes of the blades (20*a* to 20*c*) significantly affecting the magnitudes of aerodynamic forces acting on the respective blades (20*a* to 20*c*) are the same. Thus, the differences among the aerodynamic forces acting on the blades (20*a* to 20*c*) having different masses $M_1$, $M_2$, and $M_3$ are reduced.

—Blowing Sound of Propeller Fan—

Blowing sound of a propeller fan (10) will be described with reference to FIG. 3.

Figure 3:
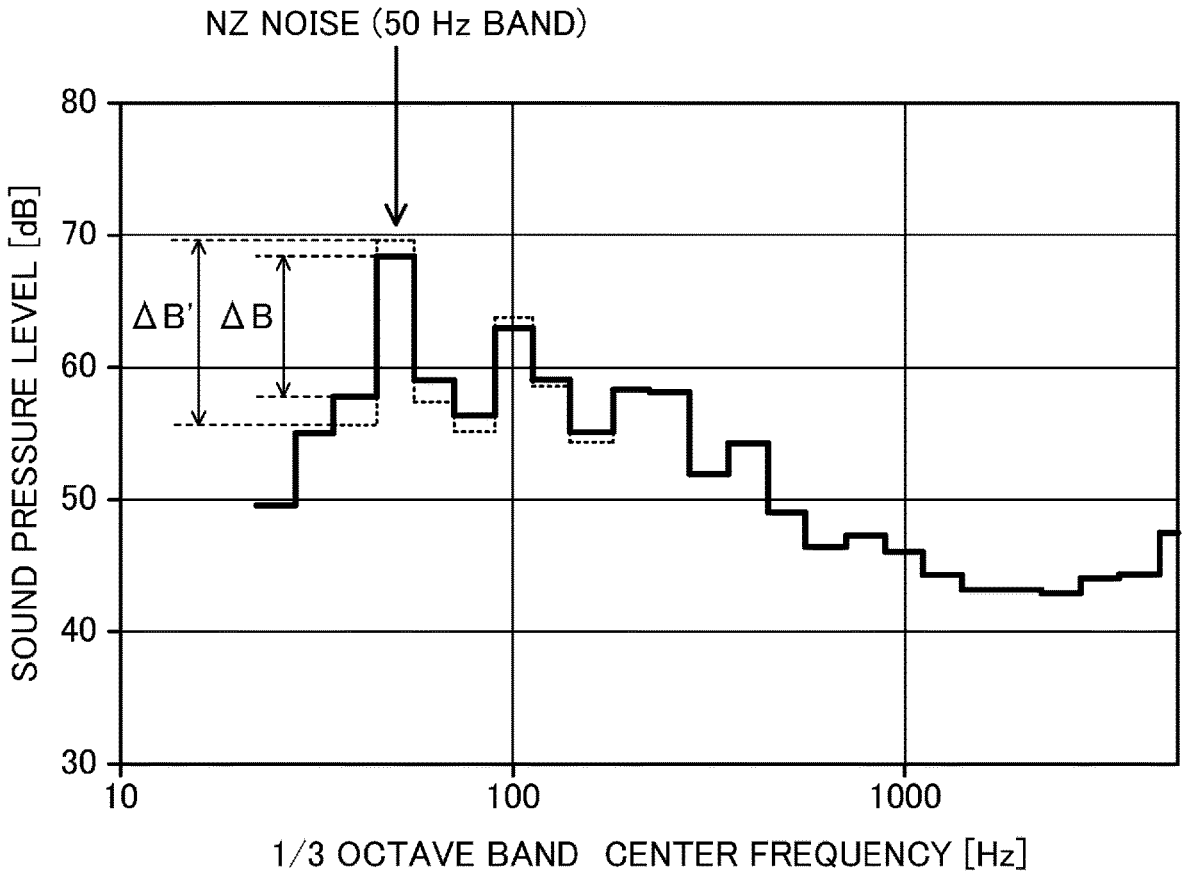
FIG. 3 is a graph showing the measurement results of blowing sound of the propeller fan.

In FIG. 3, the measurement result of the blowing sound of the propeller fan (10) of this embodiment is indicated by the solid line, and the measurement result of blowing sound of a propeller fan of a comparative example is indicated by the broken line. The propeller fan of the comparative example includes three blades having the same shape as the first blade (20*a*) of this embodiment. These three blades are circumferentially arranged at regular intervals. In other words, in the propeller fan of the comparative example, the circumferential pitches of the blades are all 120°.

As shown in FIG. 3, the propeller fan (10) of this embodiment has a lower sound pressure level in a frequency band including frequencies of NZ noise than the propeller fan of the comparative example, while having a higher sound pressure level in a frequency band adjacent to the frequency band including the frequencies of the NZ noise.

Here, as the difference in sound pressure level between the frequency band including the frequencies of the NZ noise and the frequency band adjacent to the frequency band including the frequencies of the NZ noise increases, the discomfort imparted to a person by the NZ noise increases. As shown in FIG. 3, the difference AB of the propeller fan (10) of this embodiment between the sound pressure levels in these two frequency bands is smaller than the difference AB' of the propeller fan of the comparative example therebetween. Thus, the propeller fan (10) of this embodiment including the blades (20*a* to 20*c*) having different circumferential pitches allows the discomfort imparted to a person by the NZ noise to be less than that of the propeller fan of the comparative example.

—Advantages of First Embodiment—

Unequal circumferential pitches of the blades (20*a* to 20*c*) of the propeller fan (10) of this embodiment can reduce the discomfort resulting from the so-called NZ noise, and unequal masses of the blades (20*a* to 20*c*) can reduce vibrations of the propeller fan (10). Furthermore, in the propeller fan (10) of this embodiment, one or more of various shapes of the blades (20*a* to 20*c*) significantly affecting the aerodynamic forces acting on the blades (20*a* to 20*c*) are common among all the blades (20*a* to 20*c*). This enables equalization of the aerodynamic forces acting on the blades (20*a* to 20*c*) of the propeller fan (10), and can reduce the degree to which noise increases due to different aerodynamic forces acting on the blades (20*a* to 20*c*). Thus, this embodiment can provide a high-performance propeller fan (10) capable of reducing the discomfort resulting from NZ noise while reducing the degrees to which noise and vibrations increase.

In addition, in this embodiment, different thicknesses of the blade body portions (42*a* to 42*c*) of the blades (20*a* to 20*c*) allow the blades (20*a* to 20*c*) to have different masses. The thicknesses of the blade body portions (42*a* to 42*c*) insignificantly affect the magnitudes of the aerodynamic forces acting on the blades (20*a* to 20*c*). Thus, this embodiment allows the blades (20*a* to 20*c*) to have different masses while enabling equalization of the aerodynamic forces acting on all the blades (20*a* to 20*c*) of the propeller fan (10).

In addition, in this embodiment, since the blades (20*a* to 20*c*) of the propeller fan (10) have different circumferential pitches and different masses, the differences among the circumferential pitches of the blades (20*a* to 20*c*) and the differences among the masses of the blades (20*a* to 20*c*) can be minimized. Thus, this embodiment can reliably shorten the distance between the center of gravity and rotational center axis (11) of the propeller fan (10), and allows the propeller fan (10) to be rotationally balanced with ease and reliability.

In this embodiment, since the blades (20*a* to 20*c*) of the propeller fan (10) having different circumferential pitches have different masses, the propeller fan (10) is rotationally balanced. Therefore, the propeller fan (10) of this embodiment that has just been injection-molded has already been rotationally balanced. Therefore, according to this embodiment, the propeller fan (10) including the blades (20*a* to 20*c*) having different circumferential pitches can be manufactured without attaching another member, such as a balance weight, to the propeller fan (10).

Second Embodiment

A second embodiment will be described. A propeller fan (10) of this embodiment is obtained by changing the shape of blades (20*a* to 20*c*) of the propeller fan (10) of the first embodiment. The propeller fan (10) of this embodiment will be described mainly through explaining a difference between the propeller fan (10) of this embodiment and the propeller fan (10) of the first embodiment.

Figure 4A:
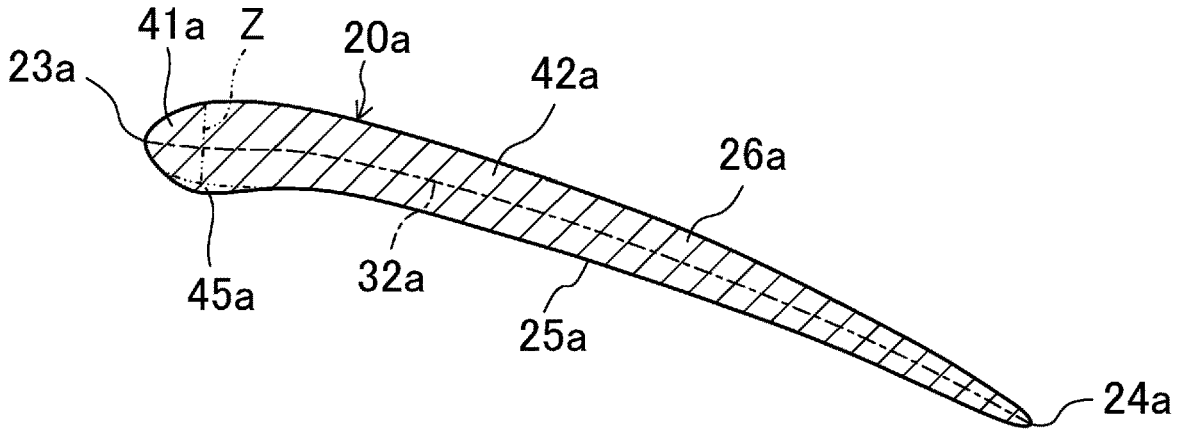
FIG. 4A is a cross-sectional view of a first blade of a second embodiment.
Figure 4B:
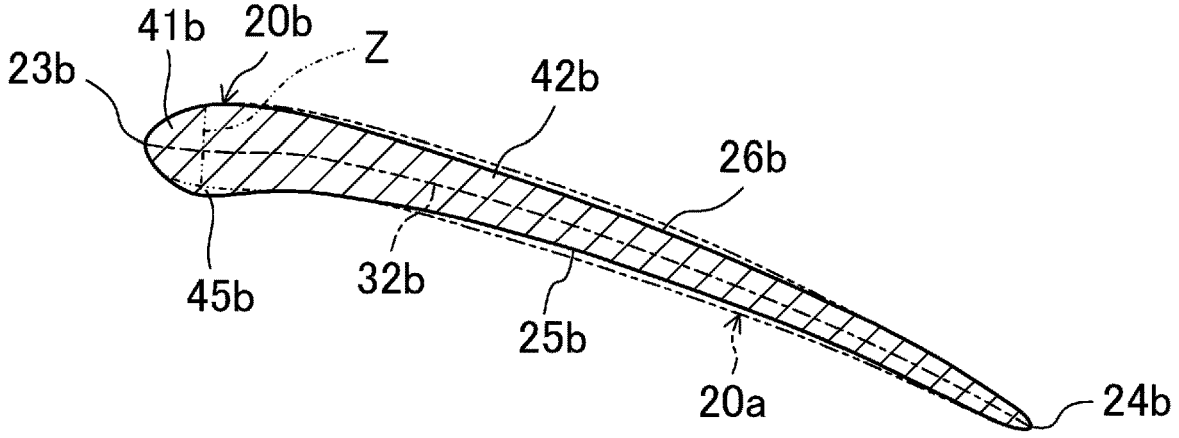
FIG. 4B is a cross-sectional view of a second blade of the second embodiment.
Figure 4C:
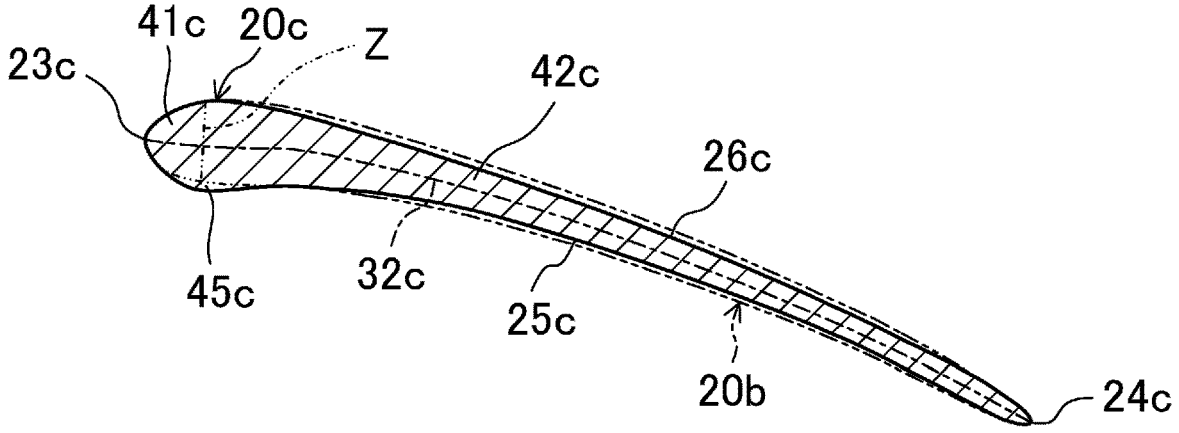
FIG. 4C is a cross-sectional view of a third blade of the second embodiment.

As shown in FIGS. 4A to 4C, the blades (20*a* to 20*c*) of this embodiment each have a protrusion (45*a*, 45*b*, 45*c*). The protrusion (45*a* to 45*c*) protrudes toward the positive pressure surface (25*a* to 25*c*) of the blade (20*a* to 20*c*), and extends along the leading edge portion (41*a* to 41*c*) across the length of the leading edge portion (41*a* to 41*c*). The surface of the protrusion (45*a* to 45*c*) is a convex surface that is smoothly continuous with a surface of a region of the blade (20*a* to 20*c*) adjacent to the protrusion (45*a* to 45*c*). The protrusions (45*a* to 45*c*) of the blades (20*a* to 20*c*) have the same shape. In other words, the leading edge portions (41*a* to 41*c*) of the blades (20*a* to 20*c*) of this embodiment have the same shape, and the protrusions (45*a* to 45*c*) of the blades (20*a* to 20*c*) have the same shape.

Each blade (20*a* to 20*c*) having the protrusion (45*a* to 45*c*) allows air to flow smoothly and separately toward the associated positive pressure surface (25*a* to 25*c*) and the associated negative pressure surface (26*a* to 26*c*) of the blade at the leading edge (23*a* to 23*c*) of the blade (20*a* to 20*c*). This can reduce the blowing sound. On the other hand, the protrusions (45*a* to 45*c*) are respectively disposed along the leading edges (23*a* to 23*c*) of the blades (20*a* to 20*c*). Thus, the shape of the protrusions (45*a* to 45*c*) relatively significantly affects the aerodynamic forces acting on the blades (20*a* to 20*c*). In contrast, the protrusions (45*a* to 45*c*) of the blades (20*a* to 20*c*) of the propeller fan (10) of this embodiment have the same shape. Thus, according to this embodiment, reducing the differences among the aerodynamic forces acting on the blades (20*a* to 20*c*) of the propeller fan (10), and the protrusions (45*a* to 45*c*) functioning to adjust the air flow can further reduce the blowing sound of the propeller fan (10).

Other Embodiments

The number of blades (20*a* to 20*c*) of the propeller fan (10) of each of the foregoing embodiments may be an odd number greater than or equal to five. Alternatively, the number of blades (20*a* to 20*c*) of the propeller fan (10) of each of the foregoing embodiments may be an even number.

Not all but some of the blades of the propeller fan (10) of each of the foregoing embodiments may have different circumferential pitches and different masses.

In the propeller fan (10) of this embodiment, the camber lines (32*a* to 32*c*) of the blades (20*a* to 20*c*) have a common shape, projections of the blades (20*a* to 20*c*) on the plane perpendicular to the rotational center axis (11) of the propeller fan (10) have a common shape, and the leading edge portions (41*a* to 41*c*) of the blades (20*a* to 20*c*) have a common shape. Even if the differences among the shapes of "the camber lines (32*a* to 32*c*)" of the blades (20*a* to 20*c*), the differences among the shapes of "projections of the blades (20*a* to 20*c*) on the plane perpendicular to the rotational center axis (11) of the propeller fan (10)," and the differences among the shapes of "the leading edge portions (41*a* to 41*c*)" each exceed the usual tolerance, these shapes can be said to be common among the blades (20*a* to 20*c*) as long as the differences in shape only slightly affect the aerodynamic forces acting on the blades (20*a* to 20*c*).

The protrusions (45*a* to 45*c*) of the blades (20*a* to 20*c*) of the propeller fan (10) of the second embodiment merely need to have a common shape. Even if the differences among the shapes of "the protrusions (45*a* to 45*c*)" of the blades (20*a* to 20*c*) each exceed the usual tolerance, these shapes can be said to be common among the blades (20*a* to 20*c*) as long as the differences in shape only slightly affect the aerodynamic forces acting on the blades (20*a* to 20*c*).

INDUSTRIAL APPLICABILITY

As can be seen from the foregoing description, the present invention is usable as a propeller fan.

DESCRIPTION OF REFERENCE CHARACTERS

10 Propeller Fan
11 Rotational Center Axis
15 Hub
20*a* First Blade
20*b* Second Blade
20*c* Third Blade
24*a*, 24*b*, 24*c* Trailing Edge
25*a*, 25*b*, 25*c* Positive Pressure Surface
41*a*, 41*b*, 41*c* Leading Edge Portion
45*a*, 45*b*, 45*c* Protrusion

The invention claimed is:

1. A propeller fan comprising:

a hub formed into a cylindrical shape; and a plurality of blades extending outward from a side of the hub, at least two of the plurality of blades having different circumferential pitches, at least two of the plurality of blades having different masses so that a center of gravity of the propeller fan is positioned substantially on a rotational center axis of the propeller fan, the plurality of blades and the hub being integrally formed, and the plurality of blades and the hub being a single resin member, and projections of the plurality of blades on a plane orthogonal to the rotational center axis of the propeller fan having a substantially the same shape, a shape of leading edge portions of the plurality of blades in cross-sectional view being substantially the same, and a thickness of the plurality of blades at the leading edge portions in cross-sectional view being substantially the same.

2. The propeller fan of claim 1, wherein regions of at least a first blade and a second blade among the plurality of blades closer to trailing edges than to the leading edge portions in cross-sectional view partly or entirely have different thicknesses, and at least the first blade and the second blade have different masses.

3. The propeller fan of claim 2, wherein all of the plurality of blades have different circumferential pitches and different masses.

4. The propeller fan of claim 2, wherein the plurality of blades each have a protrusion extending along an associated one of the leading edge portions and protruding toward a positive pressure surface, and the protrusions of all of the plurality of blades have a substantially the same shape.

5. The propeller fan of claim 1, wherein all of the plurality of blades have different circumferential pitches and different masses.

6. The propeller fan of claim 5, wherein the plurality of blades each have a protrusion extending along an associated one of the leading edge portions and protruding toward a positive pressure surface, and the protrusions of all of the plurality of blades have a substantially the same shape.

7. The propeller fan of claim 1, wherein the plurality of blades each have a protrusion extending along an associated one of the leading edge portions and protruding toward a positive pressure surface, and the protrusions of all of the plurality of blades have a substantially the same shape.

* * * * *